US006696955B2

(12) United States Patent
Kolton et al.

(10) Patent No.: US 6,696,955 B2
(45) **Date of Patent: *Feb. 24, 2004**

(54) ELECTRONIC ARTICLE SURVEILLANCE MARKER AND CONTAINER THEREWITH

(75) Inventors: Chester Kolton, Westfield, NJ (US); Michael Norman, East Brunswick, NJ (US)

(73) Assignee: B&G Plastics, Inc., Newark, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/091,060

(22) Filed: Mar. 5, 2002

(65) Prior Publication Data

US 2003/0169170 A1 Sep. 11, 2003

(51) Int. Cl.[7] ..... G08B 13/14
(52) U.S. Cl. ..... 340/572.8; 340/572.1
(58) Field of Search ..... 340/572.8, 572.1

(56) References Cited

U.S. PATENT DOCUMENTS 3,911,534 A * 10/1975 Martens et al. ..... 340/572.8 X
4,712,094 A * 12/1987 Bolson, Sr. ..... 340/572.8
4,804,943 A * 2/1989 Soleimani ..... 340/572.1 X
5,025,246 A * 6/1991 Schenkel ..... 340/572.1
5,375,712 A * 12/1994 Weisburn ..... 206/387
5,790,029 A * 8/1998 Curnutte et al. ..... 340/572.1
6,137,413 A * 10/2000 Ryan, Jr. ..... 340/572.8
6,191,691 B1 * 2/2001 Serrault ..... 340/572.8
6,342,838 B1 1/2002 Kolton et al. ..... 340/572.1
6,554,186 B1 * 4/2003 Okamura ..... 235/383

* cited by examiner

*Primary Examiner*—Thomas J Mullen
(74) *Attorney, Agent, or Firm*—Robin, Blecker & Daley

(57) ABSTRACT

An EAS marker assembly comprises a housing defining an interior cavity and an EAS marker and a weighting member disposed in the housing interior cavity, the weighting member being of a composition which does not interfere with operation of the EAS marker. A container has an inlet/outlet port and an EAS marker assembly is configured to be passable through the inlet/outlet port into an interior of the container and thereupon to expand to a dimension exceeding a dimension of the container inlet/outlet port, the EAS marker assembly including therein a weighting member.

15 Claims, 3 Drawing Sheets

ELECTRONIC ARTICLE SURVEILLANCE MARKER AND CONTAINER THEREWITH

FIELD OF THE INVENTION

This invention relates generally to electronic article surveillance (EAS) markers and pertains more particularly to EAS markers for containers having a tamper-resistant character.

BACKGROUND OF THE INVENTION

Commonly-assigned U.S. Pat. No. 6,342,838 B1 addresses the problem wherein the customary adhesive-backed EAS marker applied to the exterior of a container can be removed by an unscrupulous customer with ease, thereby rendering the article without EAS protection and removable from a facility without being paid for.

In the commonly-assigned patent, an EAS marker assembly comprises a housing defining an interior cavity and an EAS marker disposed in the housing interior cavity, the housing having an exterior flexible member cantilever-supported by the housing. The patent further provides, in combination, a container having an inlet/outlet port and an EAS marker assembly configured to be passable through the inlet/outlet port into an interior of the container and thereupon to expand to a dimension exceeding a dimension of the container inlet/outlet port.

More particularly, in the '838 patent, the flexible member is formed integrally with housing and includes a thinned section which permitting the flexible member to pivot relative to the housing, i.e., the flexible member is cantilever-supported by the housing.

As is seen in FIG. 4 of the '838 patent, the EAS marker assembly is shown partly within the neck of a container. The marker assembly width is selected to permit the marker assembly to be inserted into neck of the container. In the course of insertion, the flexible member is pivoted upwardly about the housing by engagement of the flexible member to become generally aligned with the housing in the course of insertion. As the flexible member clears the container neck, i.e., enters the interior of the container, the flexible member returns to its spring-biased disposition outwardly of the housing and the EAS marker assembly thus becomes entrapped within the container.

Once the fact becomes known that a container is equipped with an EAS marker assembly of the type disclosed in the '838 patent, a door is opened to unscrupulous shoppers for removing the container closure member (cap) from the container and endeavoring to remove the EAS marker assembly therefrom, i.e., by reaching into the container neck and manipulating the flexible members to facilitate removal of the EAS marker assembly.

While such shopper manipulation can be readily prevented for containers having neck and EAS marker assembly dimensions incompatible with shopper manipulation, the manipulation is possible where such incompatibility does not apply.

SUMMARY OF THE INVENTION

The present invention has as its primary object an improved electronic article surveillance marker and container assembly.

A more particular object of the present invention is to provide container-insertable EAS marker assemblies with a tamper-resistant character.

In attaining these and other objects, the present invention provides an EAS marker assembly comprising a housing defining an interior cavity and an EAS marker and a weighting member disposed in the housing interior cavity, the weighting member being of a composition which does not interfere with operation of the EAS marker. The housing preferably defines separate compartments for the EAS marker and the weighting member.

More particularly, the EAS marker is deactivatible by a magnetic field and the weighting member is comprised of a non-magnetic material.

A further object of the invention is to provide improved EAS marker assemblies of the type disclosed in the '838 patent.

In attaining this further and other objects, applicants provide, in one aspect, an EAS marker assembly comprising a housing defining an interior cavity and an EAS marker, and a weighting member disposed in the housing interior cavity, the housing having an exterior flexible member cantilever-supported by the housing.

In another aspect, applicants provide, in combination, a container having an inlet/outlet port and an EAS marker assembly configured to be passable through the inlet/outlet port into an interior of the container and thereupon to expand to a dimension exceeding a dimension of the container inlet/outlet port, the EAS marker assembly including therein a weighting member.

The invention will be further understood from consideration of the following description of preferred embodiments thereof and from the drawings where like reference numerals identify like parts throughout.

DETAILED DESCRIPTION OF PREFERRED EMBODIMENTS

Figure 2:
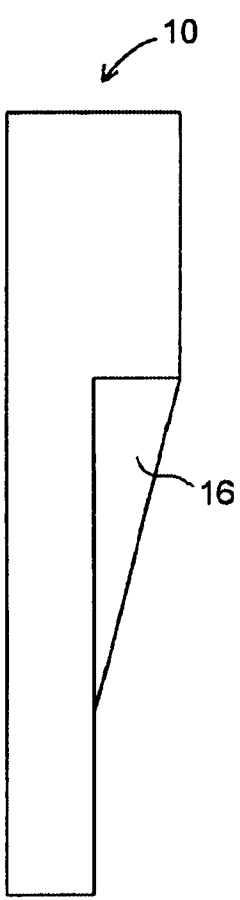
FIG. 2 is a right side elevation of the FIG. 1 housing part.
Figure 1:
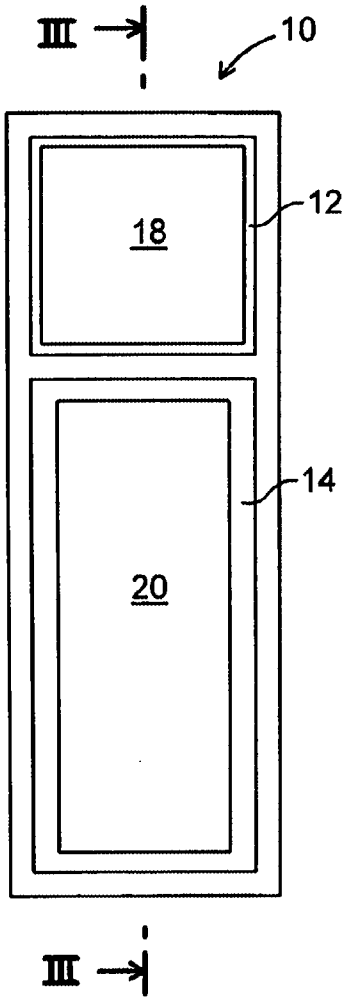
FIG. 1 is a front elevation of a first housing part of an EAS marker assembly in accordance with the invention.
Figure 3:
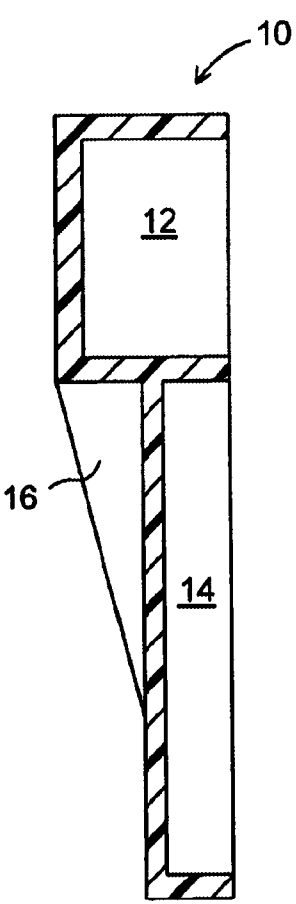
FIG. 3 is a sectional view as would be seen from plane III—III of FIG. 1, prior to placement of the EAS marker and weighting member therein.

Referring to FIGS. 1–3, first housing part 10 is a molded plastic body formed with interior sidewalls and a floor jointly defining cavities 12 and 14. A pair of ribs, one being shown at 16 extend from the floor of cavity 12 to the floor of cavity 14.

Weighting member 18 is disposed in cavity 12 and EAS marker 20 is disposed in cavity 14 (FIG. 1).

Figure 5:
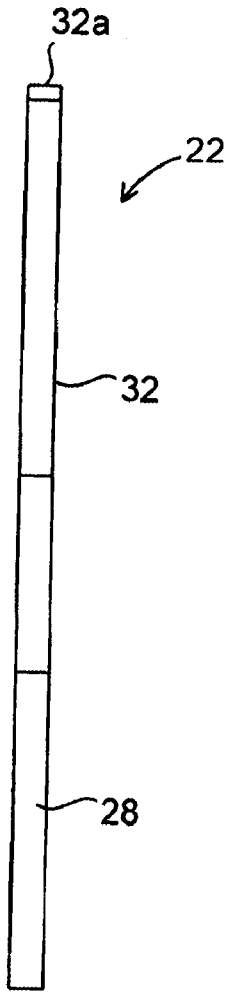
FIG. 5 is a right side elevation of the FIG. 4 housing part.
Figure 4:
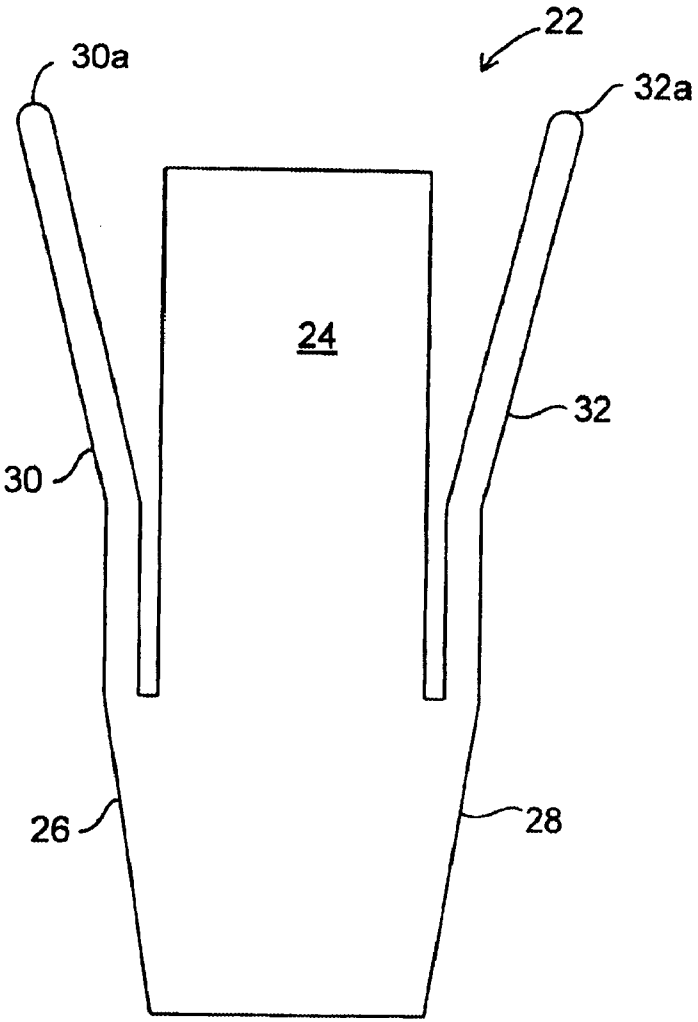
FIG. 4 is a front elevation of a second housing part of an EAS marker assembly in accordance with the invention.

Turning to FIGS. 4 and 5, second housing part 22, also a molded plastic body, includes a central portion 24 of common length and width with first housing part 10. Flanges 26 and 28 are formed outwardly at the lower part of central portion 24. Flexible members 30 and 32 are formed at the respective tops of flanges 26 and 28 and extend as shown to free ends 30*a* and 32*a* transversely outwardly of central portion 24.

EAS marker assembly 34 (FIG. 6) is placing housing part 22 in overlying relation with housing part 10, after disposing weighting member 18 and EAS marker 20 respectively in cavities 12 and 14, with flexible member free ends 30*a* and 32*a* being upwardly of cavity 12. The housing parts are then perimetrically heat sealed to one another, e.g., by ultrasonic heating apparatus, or otherwise joined to form assembly 34.

Figure 6:
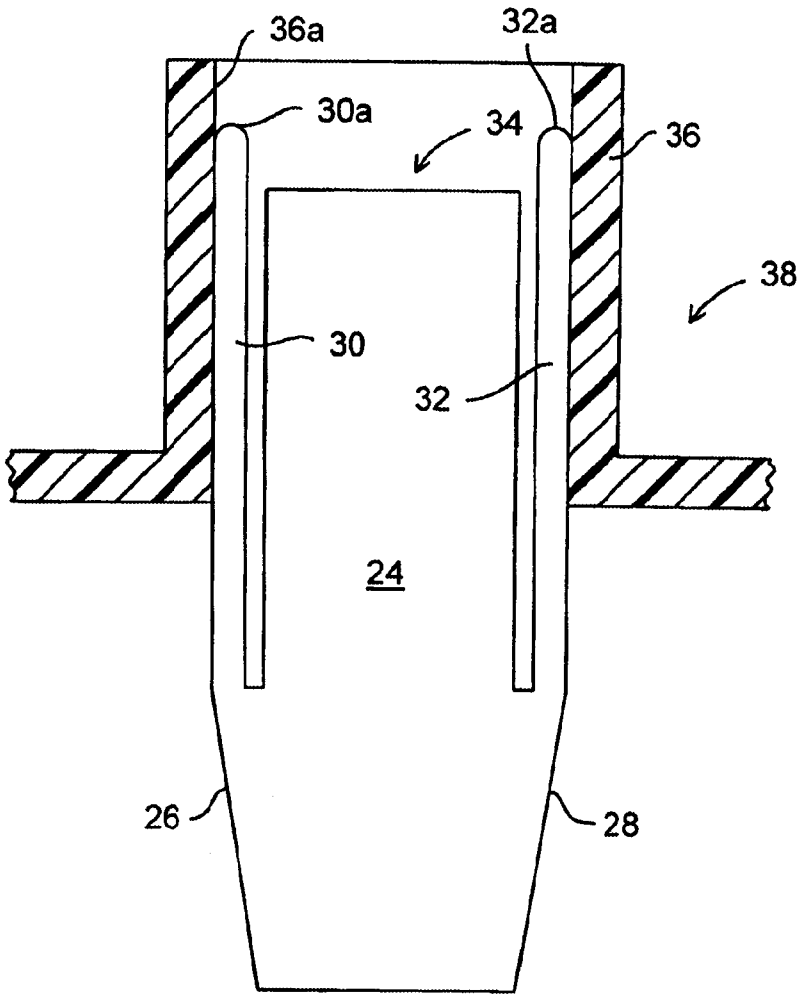
FIG. 6 is partial view of a vessel, shown in section, and an EAS marker assembly in accordance with the invention in the course of insertion thereof into the vessel.

In FIG. 6, EAS marker assembly 34 is shown in the course of its insertion into neck 36 of container 38. As is seen, flexible members 30 and 32 are forced by interior wall 36*a* of neck 36 from their FIG. 4 disposition toward central portion 24 of EAS marker assembly 34 to extend generally parallel therewith.

Upon completion of insertion of EAS marker assembly 34 into container 38, flexible members 30 and 32 flex outwardly to resume their FIG. 4 disposition, i.e., the members are self-biased to the FIG. 4 disposition. In such self-biased disposition, the transverse spacing between flexible member free ends 30*a* and 32*a* exceeds the diameter of container neck 36, thus retaining EAS marker assembly 34 within the container.

Per the subject invention, the inclusion of weighting member 18 in EAS marker assembly 34 provides for gravity-forced sinking of the inserted marker assembly into the interior of container 38, i.e., away from container neck 36, whereby the inserted marker is not accessible to a potential customer thereof.

Incorporating reference is made to the '838 patent. In addition to the tamper-resistance and weighting member difference therefrom, assemblies in accordance with the subject invention have their flexible members extending upwardly from the lower portion thereof to free ends upwardly of the top end of the central portion containing the weighting member and the EAS marker. The flexible members hereof will be seen not to require the thinned-out sections, defining hinges for the flexible members.

The EAS marker employed in practicing the invention is of a type which is deactivatable by a magnetic field. The weighting element is comprised of a non-magnetic material, e.g., zinc, lead, or stainless steel, such that the weighting member does not interfere with operation of the EAS marker.

Various changes may be introduced in the disclosed preferred embodiments without departing from the invention. For example, the EAS marker assembly with enclosed EAS marker and weighting member may be employed without the flexible members. Tamper resistance then resides in the fact that the EAS marker assembly is gravity forced into a disposition in the container remote from the container inlet port. Further, while the invention is disclosed in its preferred embodiment with plural flexible members, evidently only one such flexible member is required. Accordingly, it is to be appreciated that the true spirit and scope of the invention is set forth in the following claims.

What is claimed is:

1. An EAS marker assembly for use with a container comprising:

(a) a housing configured to be insertable through a container opening into the interior of said container defining an interior cavity; and (b) an EAS marker and a weighting member disposed in said housing interior cavity, said EAS marker assembly being gravity-forced into a position distal from said container opening by said weighting member.

2. The EAS marker assembly claimed in claim 1, wherein said housing defines separate parts of said interior cavity, said EAS marker being disposed in one separate part of said interior cavity, said weighting member being disposed in the other separate part of said interior cavity.

3. The EAS marker assembly claimed in claim 1, wherein said EAS marker is deactivatable by a magnetic field and wherein said weighting member is comprised of a non-magnetic material.

4. The EAS marker claimed in claim 3, wherein said housing defines separate parts of said interior cavity, said EAS marker being disposed in one separate part of said interior cavity, said weighting member being disposed in the other separate part of said interior cavity.

5. In combination:

(a) a container having an inlet/outlet port; and (b) a housing configured to be insertable through said container inlet/outlet port into the interior of said container and defining an interior cavity; and (c) an EAS marker and a weighting member disposed in said housing interior cavity, said EAS marker being gravity-forced into a position distal from said container inlet/outlet port by said weighting member.

6. The invention claimed in claim 5, wherein said housing defines separate parts of said interior cavity, said EAS marker being disposed in one separate part of said interior cavity, said weighting member being disposed in the other separate part of said interior cavity.

7. The invention claimed in claim 5, wherein said EAS marker is deactivatable by a magnetic field and wherein said weighting member is comprised of a non-magnetic material.

8. The invention claimed in claim 7, wherein said housing defines separate parts of said interior cavity, said EAS marker being disposed in one separate part of said interior cavity, said weighting member being disposed in the other separate part of said interior cavity.

9. An EAS marker assembly comprising:

(a) a housing defining an interior cavity;

(b) an EAS marker and weighting member disposed in said housing interior cavity, said housing having an exterior flexible member cantilever-supported by said housing.

10. The assembly claimed in claim 9, wherein said flexible member extends upwardly from a lower portion of said housing, a free end of said flexible member extending upwardly of said interior cavity and being upwardly adjacent said weighting member.

11. The assembly claimed in claim 10, wherein said flexible member is bendable to be alignable with a wall of said housing.

12. The assembly claimed in claim 9, wherein said housing is comprised of first and second housing parts, said first housing part defining said interior cavity.

13. The assembly claimed in claim 12, wherein said flexible member is supported by said second housing part.

14. The assembly claimed in claim 13, wherein said flexible member and said housing part comprise an integral, one-piece body.

15. The assembly claimed in claim 12, wherein said first and second housing parts are peripherally secured to one another.

* * * * *